US007984909B2

(12) United States Patent
Sunohara

(10) Patent No.: US 7,984,909 B2
(45) Date of Patent: Jul. 26, 2011

(54) IMAGE FORMING APPARATUS

(75) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 462 days.

(21) Appl. No.: 12/213,415

(22) Filed: Jun. 19, 2008

(65) Prior Publication Data

US 2008/0315515 A1 Dec. 25, 2008

(30) Foreign Application Priority Data

Jun. 25, 2007 (JP) ..... 2007-166302

(51) Int. Cl.
*B65H 39/10* (2006.01)

(52) U.S. Cl. ..... 271/301; 271/303; 271/291; 271/186

(58) Field of Classification Search ..... 271/291, 271/303, 65, 186, 301
See application file for complete search history.

(56) References Cited

U.S. PATENT DOCUMENTS

| | | | | |
|---|---|---|---|---|
| 5,130,759 | A * | 7/1992 | Fushimi et al. | 399/402 |
| 6,186,497 | B1 * | 2/2001 | Johnston | 271/186 |
| 6,553,207 | B2 * | 4/2003 | Tsusaka et al. | 399/401 |
| 7,079,806 | B2 * | 7/2006 | Baek et al. | 399/405 |
| 7,699,312 | B2 * | 4/2010 | Fukuda et al. | 271/303 |
| 7,789,388 | B2 * | 9/2010 | Matsubara et al. | 271/301 |

FOREIGN PATENT DOCUMENTS

JP 2002-104707 4/2002

* cited by examiner

*Primary Examiner* — Kaitlin S Joerger
(74) *Attorney, Agent, or Firm* — Kubotera & Associates, LLC

(57) ABSTRACT

An image forming apparatus includes a first guide portion disposed to be movable for opening a transportation path of a medium; a second guide portion disposed to be movable for opening the transportation path and arranged adjacent to the first guide portion; a first transportation member for transporting the medium to the transportation path; and a second transportation member for discharging the medium from the transportation path to outside the image forming apparatus. Further, when the first guide portion and the second guide portion close the transportation path, the second guide portion is arranged to guide a rear edge of the medium.

9 Claims, 10 Drawing Sheets

IMAGE FORMING APPARATUS

BACKGROUND OF THE INVENTION

The present invention relates to an image forming apparatus.

In a conventional image forming apparatus such as a printer, a copier, a facsimile, and the likes, a charge roller charges a surface of a photosensitive drum, and an LED (Light Emitting Diode) head exposes the surface of the photosensitive drum to form a static latent image thereon. Then, a developing roller attaches a thin layer of toner to the static latent image through static electricity, thereby forming a toner image. A transfer roller transfers the toner image to a sheet.

After the transfer roller transfers the toner image to the sheet, a cleaning device removes toner remaining on the photosensitive drum, so that toner is collected in a waste toner container disposed in a toner cartridge.

After the sheet is picked up from a sheet supply unit, the sheet is transported to a transfer portion between the photosensitive drum and the transfer roller, so that the toner image is transferred to the sheet at the transfer portion, thereby forming the toner image on the sheet. Then, the sheet is transported to a fixing device, so that the fixing device fixes the toner image to the sheet, thereby forming an image on the sheet. Afterward, first and second discharge rollers of a sheet discharge unit disposed at a downstream side of the fixing device discharge the sheet to outside the printer, or outside the apparatus.

In the conventional printer, when images are formed on both sides of the sheet, an image is formed on a front side of the sheet first. After the sheet passes through the fixing device, the first and second discharge rollers transport the sheet. After a front edge of the sheet passes through the second discharge roller and a rear end of the sheet passes through the second discharge roller, the second discharge roller rotates in a reverse direction, thereby transporting the sheet to a reverse path.

After the sheet passes through the reverse path, the sheet is transported to the transfer portion one more time. Then, the toner image is formed on a backside of the sheet, and the toner image is fixed, thereby forming an image on the backside of the sheet.

In the conventional printer, the sheet discharge unit is arranged to discharge the sheet in various ways according to a material of the sheet, a thickness of the sheet, and the likes. For example, when an ordinary sheet is used as the sheet, the sheet discharge unit discharges the ordinary sheet while a side thereof with an image formed thereon faces downwardly, or the sheet discharge unit performs face down sheet discharge.

On the other hand, when a cardboard is used, it is necessary to provide a straight transportation path on a downstream side of the fixing device. Accordingly, the sheet discharge unit discharges the sheet while a side thereof with an image formed thereon faces upwardly, or the sheet discharge unit performs face up sheet discharge.

In the conventional printer, the sheet discharge unit is provided with a sheet placing tray as a medium placing tray having a sheet guide portion disposed to be freely rotatable with respect to a main body of the conventional printer or an apparatus main body. When the sheet discharge unit performs the face down sheet discharge, the sheet placing tray is closed with respect to the apparatus main body.

In this case, after the image is formed on the sheet at the transfer portion, the sheet passes through the fixing device and the first discharge roller transports the sheet. At this time, as described above, the sheet placing tray is closed with respect to the apparatus main body. The sheet is guided with the sheet guide portion disposed on the sheet placing tray and a transportation guide disposed on a downstream side of the sheet guide portion. Then, the second discharge roller discharges the sheet outside the apparatus, so that the sheet is placed on a sheet placing portion formed on a top portion of the apparatus main body.

When the sheet discharge unit performs the face up sheet discharge, the sheet placing tray is opened with respect to the apparatus main body. In this case, after the image is formed on the sheet at the transfer portion, the sheet passes through the fixing device, and the first discharge roller discharges the sheet outside the apparatus. Since the sheet placing tray is opened with respect to the apparatus main body, the sheet is placed on the sheet placing tray (refer to Patent Reference).

Patent Reference Japan Patent Publication No. 2002-104707

In the conventional printer, as described above, when the sheet discharge unit performs the face up sheet discharge, the sheet placing tray is opened with respect to the apparatus main body. After the first discharge roller transports the sheet, the sheet is directly transported to the sheet placing tray, not to the second discharge roller. Accordingly, even when the second discharge roller rotates, the sheet is not transported to the reverse path, so that the duplex printing is not performed.

In view of the problem described above, an object of the invention is to provide an image forming apparatus, in which it is possible to solve the problems of the conventional printer. In the image forming apparatus of the present invention, even when a sheet placing tray is opened with respect to an apparatus main body for performing the face up sheet discharge, it is possible to perform the duplex printing.

Further objects of the invention will be apparent from the following description of the invention.

SUMMARY OF THE INVENTION

In order to attain the objects described above, according to the present invention, an image forming apparatus includes a first guide portion disposed to be movable for opening a transportation path of a medium; a second guide portion disposed to be movable for opening the transportation path and arranged adjacent to the first guide portion; a first transportation member for transporting the medium to the transportation path; and a second transportation member for discharging the medium from the transportation path to outside the image forming apparatus.

Further, when the first guide portion and the second guide portion close the transportation path, the second guide portion is arranged to guide a rear edge of the medium.

As described above, in the image forming apparatus of the present invention, when the first guide portion and the second guide portion close the transportation path, the second guide portion is arranged to guide the rear edge of the medium. Accordingly, even when a medium placing tray is opened with respect to an apparatus main body for performing face up sheet discharge, it is possible to perform duplex printing. Further, when the first guide portion and the second guide portion open the transportation path, it is possible to transport the medium to a reverse path.

DETAILED DESCRIPTION OF THE PREFERRED EMBODIMENTS

Hereunder, embodiments of the present invention will be described in more detail with reference to the accompanying drawings. A printer of an electro-photography type will be explained as an image forming apparatus.

First Embodiment

Figure 1:
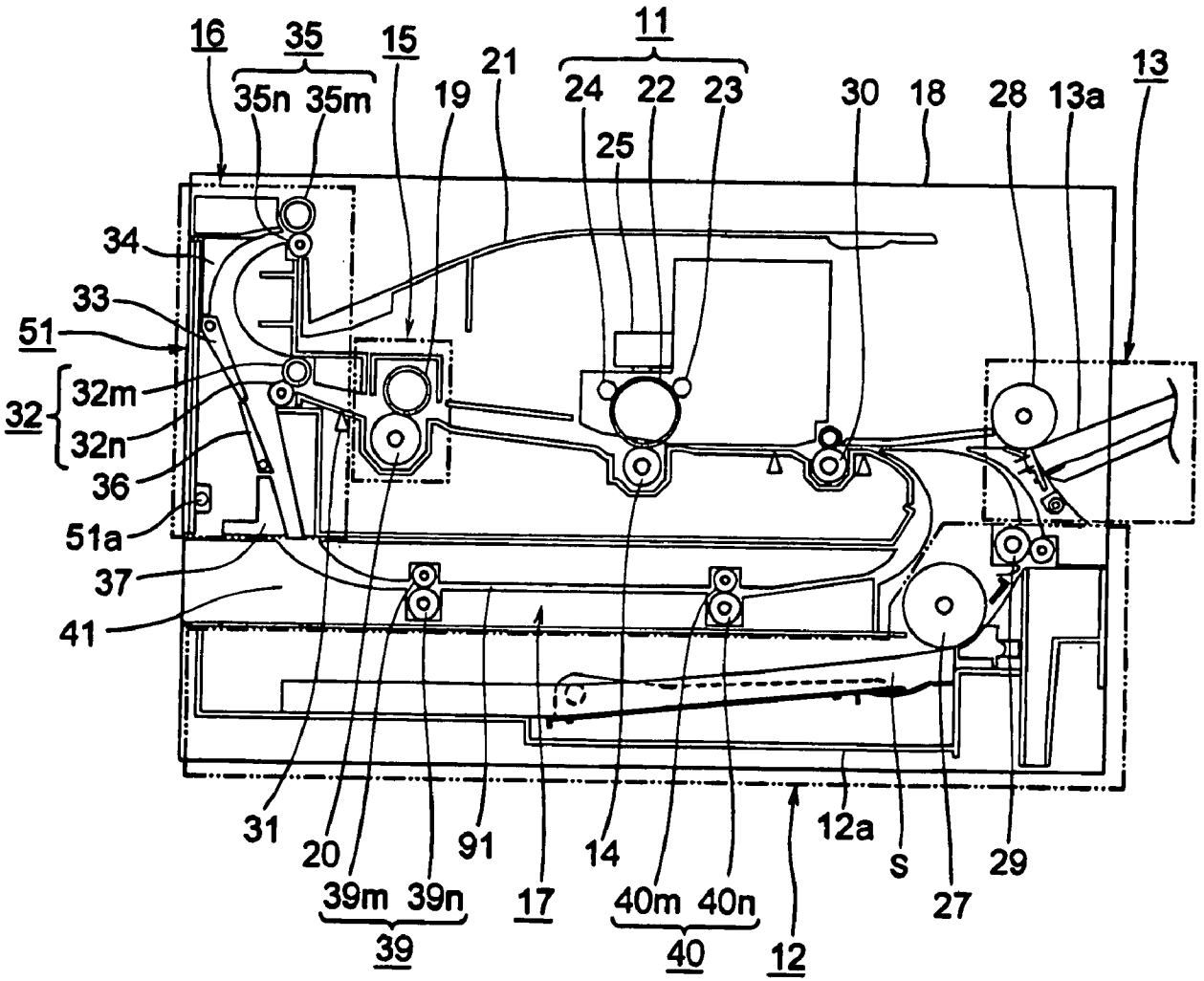
FIG. 1 is a schematic sectional view showing a printer according to a first embodiment of the present invention.
Figure 2:
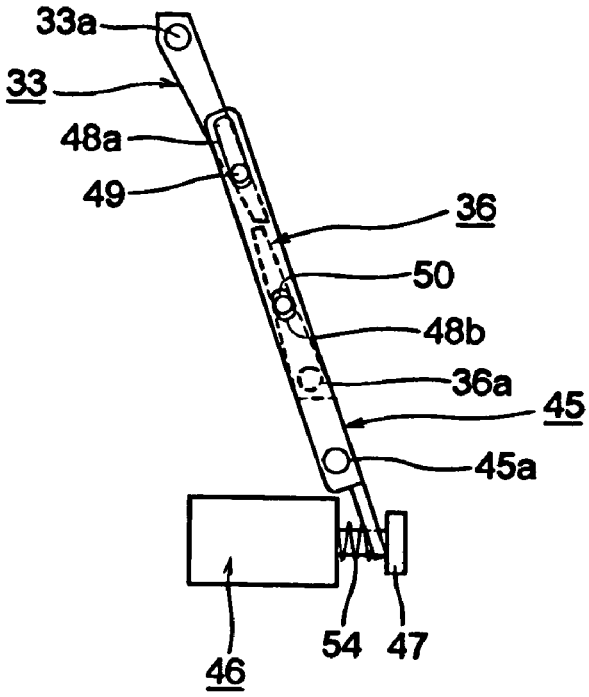
FIG. 2 is a schematic view No. 1 showing an operation of a switching guide according to the first embodiment of the present invention.
Figure 3:
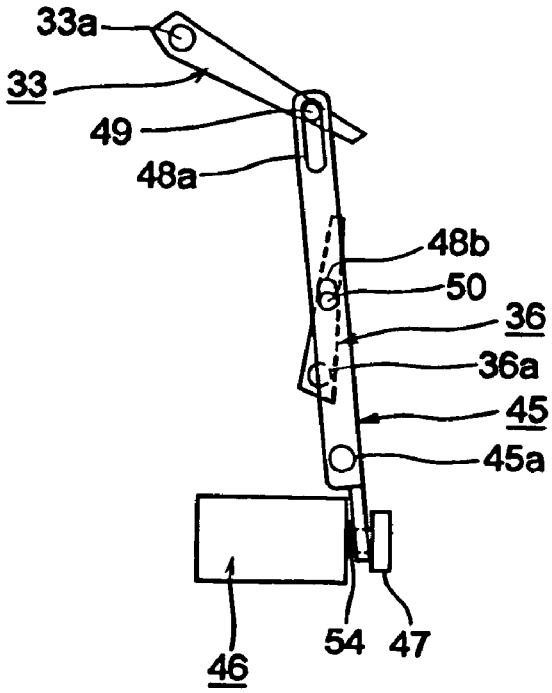
FIG. 3 is a schematic view No. 2 showing the operation of the switching guide according to the first embodiment of the present invention.

A first embodiment of the present invention will be explained. FIG. 1 is a schematic sectional view showing a printer according to the first embodiment of the present invention. FIG. 2 is a schematic view No. 1 showing an operation of a switching guide according to the first embodiment of the present invention. FIG. 3 is a schematic view No. 2 showing the operation of the switching guide according to the first embodiment of the present invention.

In the embodiment, a host computer (not shown) as an upper device sends print data (image data). According to the print data, the printer forms an image on a sheet S as a medium.

As shown in FIG. 1, the printer includes an image forming unit (ID unit) 11; a sheet supply unit 12 as a first medium supply unit; a manual feeder unit 13 as a second medium supply unit; an LED (Light Emitting Diode) head 25 as an exposure device; a transfer roller 14 as a transfer member; a fixing unit 15 as a fixing device; a sheet discharge unit 16 as a medium discharge unit; a duplex transportation unit 17; a sheet placing unit 21 as a medium placing unit disposed at a tope portion of an apparatus main body 18; and the likes.

In the embodiment, the image forming unit 11 includes a photosensitive drum 22 as an image supporting member; a developing roller 23 as a developer supporting member; and a charge roller 24 as a charge device. The LED head 25 is disposed above the photosensitive drum 22. A plurality of LED elements (not shown) is disposed in the LED head 25 in an axial direction of the photosensitive drum 22. Instead of the LED head 25, a laser scanning unit having a laser radiation unit and a polygon mirror may be used.

In the image forming unit 11, the charge roller 24 charges a surface of the photosensitive drum 22, and the LED head 25 exposes the photosensitive drum 22 to form a static latent image as a latent image. A thin layer of toner (not shown) as developer formed on the developing roller 23 statically adheres to the static latent image, thereby forming a toner image as a developer image. Then, the transfer roller 14 transfers the toner image to the sheet S.

In the embodiment, the sheet supply unit 12 includes a sheet cassette 12*a* as a medium storage unit; a first sheet supply roller 27 as a first medium supply roller; and a first transportation roller 29. Further, the manual feeder unit 13 includes a sheet supply stacker 13*a* and a second sheet supply roller 28 as a second medium supply roller. A second transportation roller 30 is disposed in a transportation path of the sheet S on a downstream side of the second sheet supply roller 28 and the first transportation roller 29.

In the embodiment, the fixing unit 15 includes a heat roller 19 as a first roller; a pressure roller 20 as a second roller; a heating member (not shown); a thermistor for detecting a temperature of the heating member; and the likes. After the toner image is transferred to the sheet S, the fixing unit 15 applies heat and pressure to the sheet S, so that the toner image is fixed to the sheet S.

In the embodiment, the sheet discharge unit 16 is disposed on a downstream side of the fixing unit 15. The sheet discharge unit 16 includes a sheet discharge sensor 31 disposed on a downstream side of the fixing unit 15 along the transportation path curved in a U character shape for detecting the sheet S; a first sheet discharge roller 32 formed of a roller 32*m* and a pressure roller 32*n* and disposed on a downstream side of the sheet discharge sensor 31; a transportation guide 34 disposed on a downstream side of the first sheet discharge roller 32; and a second sheet discharge roller 35 formed of a roller 35*m* and a pressure roller 35*n* and disposed on a downstream side of the transportation guide 34.

In the embodiment, the first sheet discharge roller 32 constitutes a first transportation member, and the second sheet discharge roller 35 constitutes a second transportation member. Further, the rollers 32*m* and 35*m* constitute a first roller, and the pressure rollers 32*n* and 35*n* constitute a second roller.

In the embodiment, the sheet discharge unit 16 includes a first switch guide 33 and a second switch guide 36 arranged adjacent to with each other. The first switch guide 33 and the second switch guide 36 are disposed on a downstream side of the first sheet discharge roller 32 along a transportation path extending toward a sidewall of the apparatus main body 18 and branched from the transportation path curved in the U character shape. Further, the sheet discharge unit 16 includes a sheet placing tray 51 as a medium placing tray disposed on a downstream side of the first switch guide 33 and the second switch guide 36.

In the embodiment, the first switch guide 33 and the second switch guide 36 constitute a first guide portion and a second guide portion, respectively. Further, the first switch guide 33 and the second switch guide 36 are arranged to be freely rotatable around shafts 33*a* and 36*a*, respectively. Similarly, the sheet placing tray 51 is arranged to be rotatable around a shaft 51*a*.

In the embodiment, a sheet discharge motor 10 (refer to FIG. 4) is provided as a sheet discharge drive unit for rotating the first sheet discharge roller 32 and the second sheet discharge roller 35. When the sheet discharge motor 10 rotates in a forward direction or a reverse direction, the first sheet discharge roller 32 and the second sheet discharge roller 35 rotate in a forward direction or a reverse direction, respectively.

In the embodiment, the duplex transportation unit 17 is disposed under the image forming unit 11. The duplex transportation unit 17 includes a reverse path 91 extending in parallel to the transportation path of the sheet S between the second transportation roller 30 and the first sheet discharge roller 32. A first duplex transportation roller 39 and a second duplex transportation roller 40 are disposed in the reverse path 91.

In the embodiment, the first duplex transportation roller 39 is formed of a pair of a roller 39*m* and a pressure roller 39*n*. The second duplex transportation roller 40 is formed of a pair of a roller 40*m* and a pressure roller 40*n*. The rollers 39*m* and 40*m* constitute a first roller, and the pressure rollers 39*n* and 40*n* constitute a second roller.

When images are formed on both sides of the sheet S, the second sheet discharge roller 35 functions as a returning member for sending the sheet S to the reverse path 91. In this case, the second sheet discharge roller 35 rotates in the forward direction to discharge the sheet S. Just before the sheet S is discharged, the second sheet discharge roller 35 rotates in the reverse direction, so that the sheet S is transported to the reverse path 91.

When the second sheet discharge roller 35 transports the sheet S, the first switch guide 33 and the second switch guide 36 guide the sheet S to a reverse guide 37. The reverse guide 37 further guides the sheet S to a duplex transportation guide 41, so that the sheet S is transported to the reverse path 91. When the sheet S is transported to the reverse path 91, the first duplex transportation roller 39 and the second duplex transportation roller 40 transport the sheet S to a transfer portion between the photosensitive drum 22 and the transfer roller 14. The transfer portion constitutes a recording portion.

An operation of the first switch guide 33 and the second switch guide 36 will be explained next. As shown in FIGS. 2 and 3, a switch lever 45 as a movement member and a solenoid 46 as a switch drive portion are provided for rotating the first switch guide 33 and the second switch guide 36.

In the embodiment, the switch lever 45 is arranged to be freely rotatable around a shaft 45*a*. One end portion of the switch lever 45 is connected to the solenoid 46 through a plunger 47, and the other end portion of the switch lever 45 has two long holes 48*a* and 48*b*. The long hole 48*a* engages a boss 49 disposed at a specific position of the first switch guide 33. The long hole 48*b* engages a boss 50 disposed at a specific position of the second switch guide 36. The long holes 48*a* and 48*b* constitute a first engagement portion and a second engagement portion, respectively. The bosses 49 and 50 constitute a first engaged portion and a second engaged portion, respectively.

When the solenoid 46 is turned off, the plunger 47 is not pulled. Accordingly, as shown in FIG. 2, the plunger 47 moves forward to a first position with an urging force of a spring 54 as an urging member disposed on a shaft of the plunger 47. As a result, the switch lever 45 rotates in a counterclockwise direction, and the first switch guide 33 and the second switch guide 36 are situated at a first switching position.

When the solenoid 46 is turned on, the plunger 47 is pulled. Accordingly, as shown in FIG. 3, the plunger 47 moves backward to a second position against the urging force of the spring 54. As a result, the switch lever 45 rotates in a clockwise direction, and the first switch guide 33 and the second switch guide 36 are situated at a second switching position.

Figure 4:
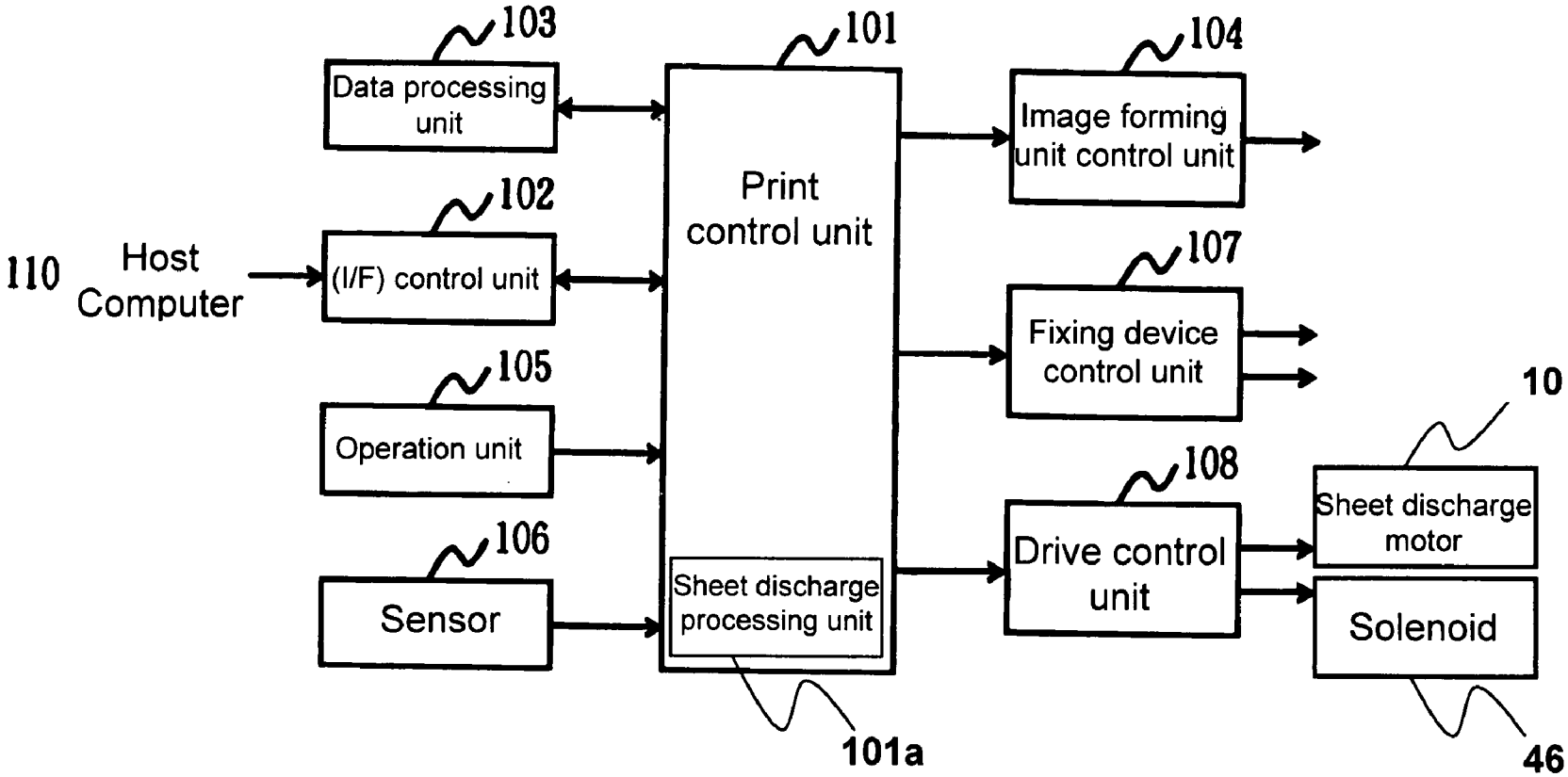
FIG. 4 is a block diagram showing a control system of the printer according to the first embodiment of the present invention.
Figure 5:
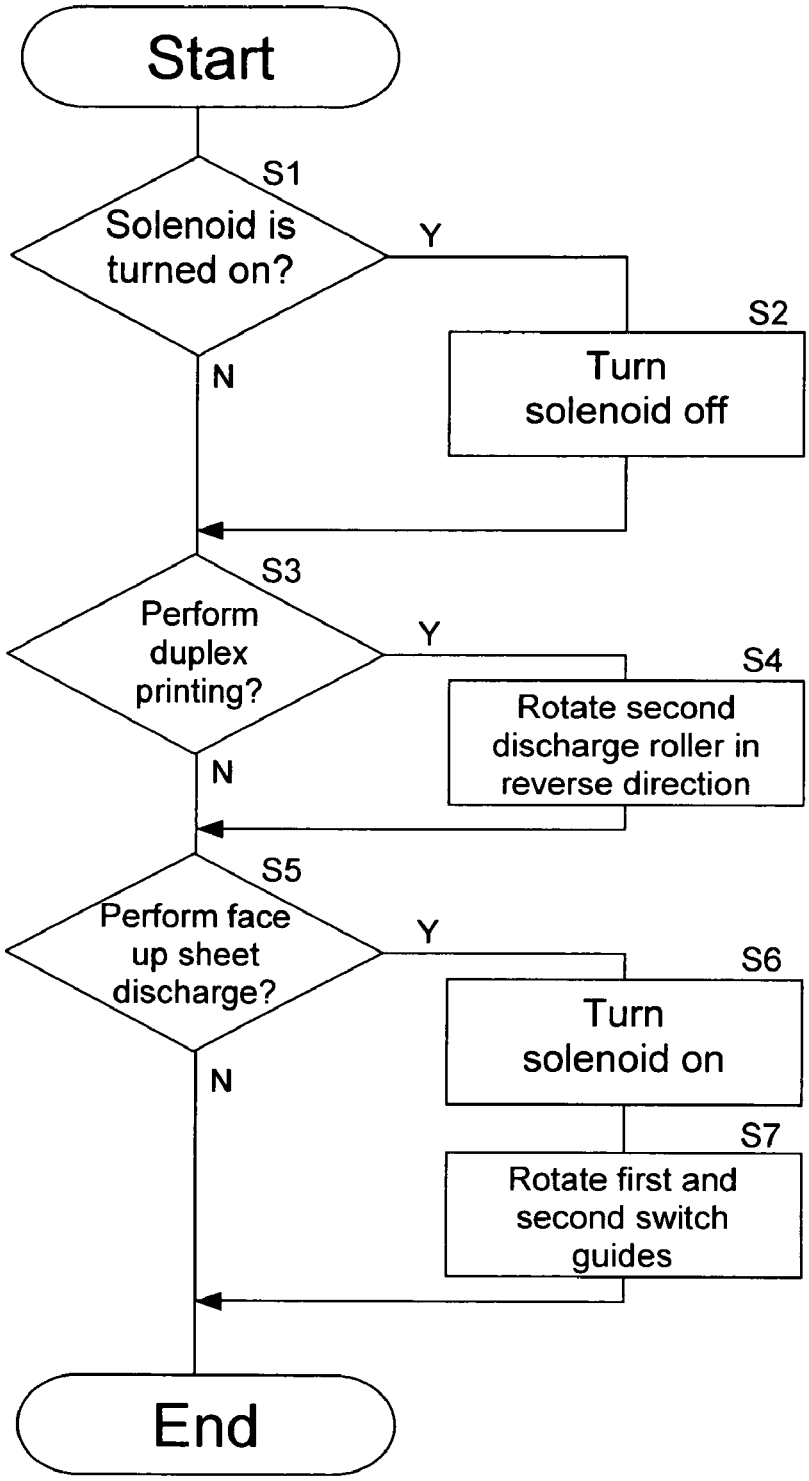
FIG. 5 is a flow chart showing an operation of the printer according to the first embodiment of the present invention.

An operation of the printer will be explained next. FIG. 4 is a block diagram showing a control system of the printer according to the first embodiment of the present invention. FIG. 5 is a flow chart showing an operation of the printer according to the first embodiment of the present invention.

Figure 6:
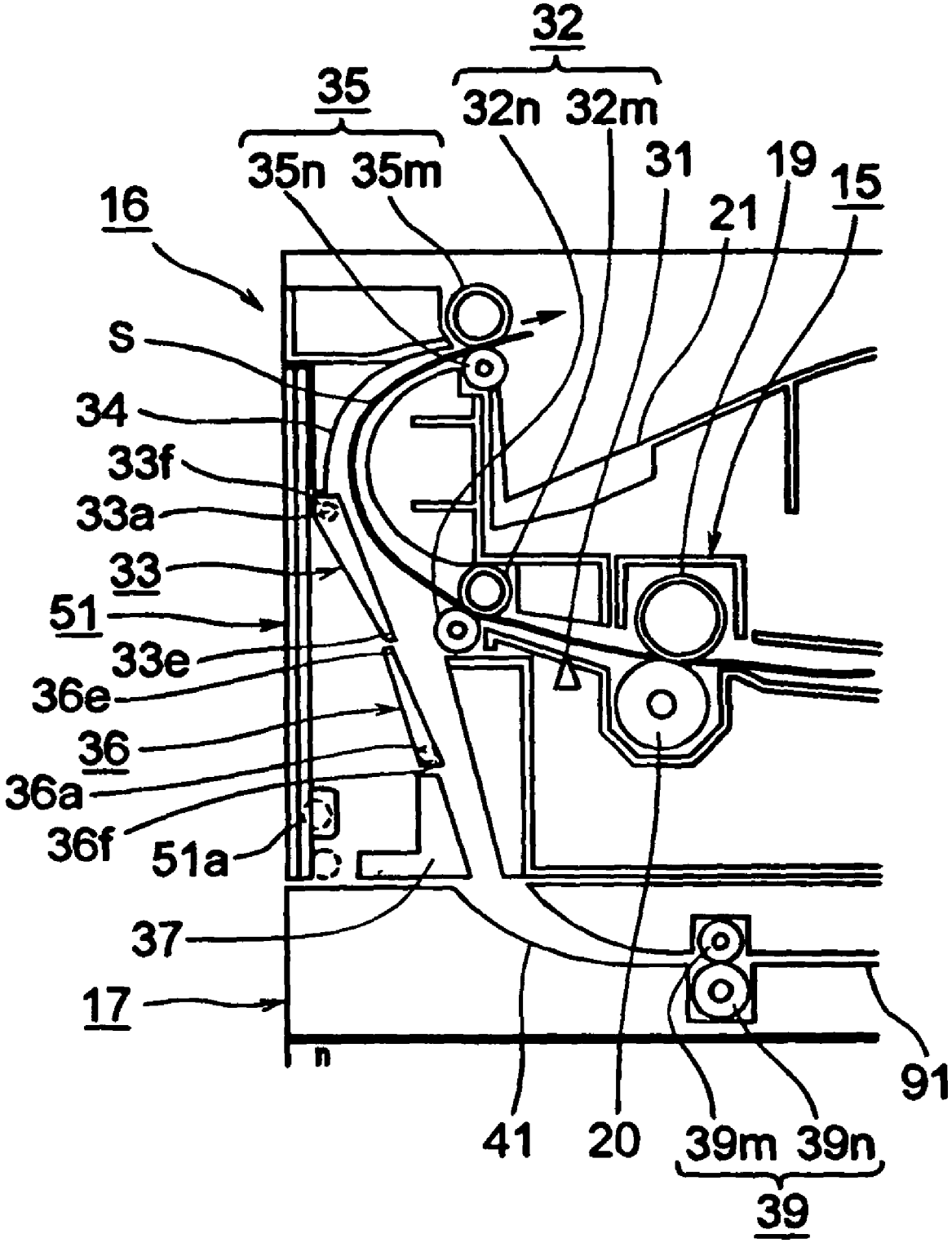
FIG. 6 is a schematic sectional view showing a sheet discharge unit when the sheet discharge unit performs face down sheet discharge according to the first embodiment of the present invention.
Figure 7:
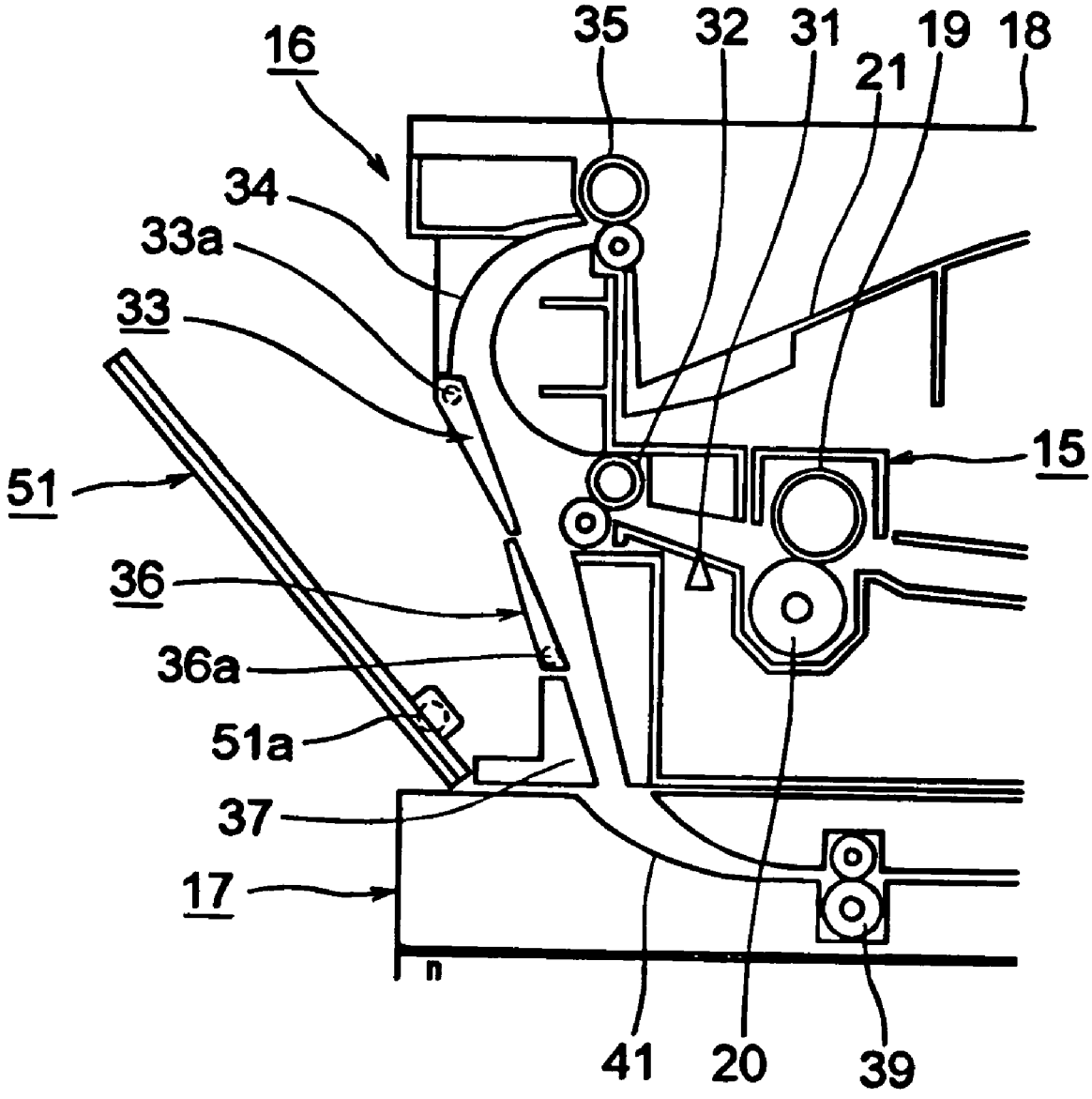
FIG. 7 is a schematic sectional view No. 1 showing the sheet discharge unit when the sheet discharge unit performs face up sheet discharge according to the first embodiment of the present invention.
Figure 8:
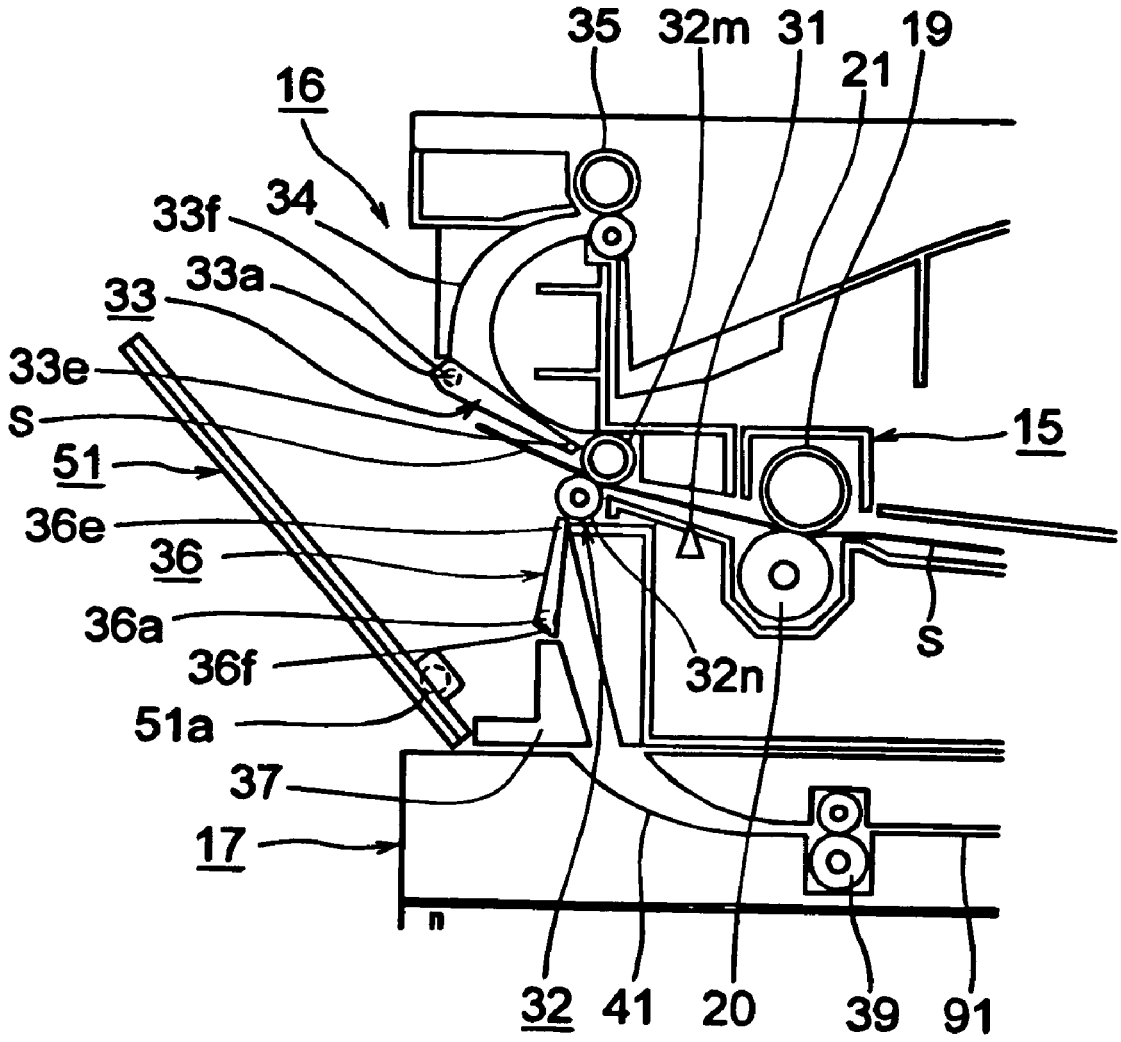
FIG. 8 is a schematic sectional view No. 2 showing the sheet discharge unit when the sheet discharge unit performs the face up sheet discharge according to the first embodiment of the present invention.

Further, FIG. 6 is a schematic sectional view showing the sheet discharge unit 16 when the sheet discharge unit 16 performs face down sheet discharge according to the first embodiment of the present invention. FIG. 7 is a schematic sectional view No. 1 showing the sheet discharge unit 16 when the sheet discharge unit 16 performs face up sheet discharge according to the first embodiment of the present invention. FIG. 8 is a schematic sectional view No. 2 showing the sheet discharge unit 16 when the sheet discharge unit 16 performs the face up sheet discharge according to the first embodiment of the present invention.

As shown in FIG. 4, the printer includes a print control unit 101; an interface (I/F) control unit 102; a data processing unit 103; an image forming unit control unit 104; an operation unit 105; a sensor 106; a fixing device control unit 107; a drive control unit 108; and the likes.

In the embodiment, the print control unit 101 is formed of a microprocessor (not shown), an ROM (Read Only Memory), an RAM (Random Access Memory), an input/output port, a timer, and the likes. The print control unit 101 receives print data and a control command from a host computer 110 through the interface (I/F) control unit 102. Further, the print control unit 101 controls the printer as a whole and performs an image forming process using a program stored in the ROM and utilizing the RAM as a specified storage area.

In the embodiment, the interface (I/F) control unit 102 controls an interface (not shown) provided in the printer. The interface control unit 102 analyzes the control command sent from the host computer 110 through the interface, and sends the control command to the print control unit 101. The data processing unit 103 receives the print data according to the control of the print control unit 101, and converts the print data to an image signal necessary for the image forming unit control unit 104.

When the image forming unit control unit 104 receives the image signal converted at the data processing unit 103, the image forming unit control unit 104 sends the image signal to the image forming unit 11 (refer to FIG. 1). When the image forming unit 11 receives the image signal, the image forming unit 11 drives the LED head 25 according to the image signal.

In the embodiment, the operation unit 105 includes an LED (not shown) and an LCD (Liquid Crystal Display) for displaying a state of the printer; a switch for inputting a direction to the printer; and the likes. An operator operates the operation unit 105 outside the printer to input a direction to the print control unit 101.

In the embodiment, the sensor 106 functions as a state detection unit for detecting various states of the sheet discharge unit 16 for transporting the sheet S, and the likes. The sensor 106 includes the sheet discharge sensor 31 for detecting the sheet S, and the likes. The print control unit 101 determines the states of the sheet discharge unit 16, the apparatus main body 18, and the likes according to a detection result of the sensor 106, thereby controlling the printer.

In the embodiment, the fixing device control unit 107 controls the fixing unit 15 according to the control of the print control unit 101. More specifically, before the sheet S with the toner image transferred thereon is transported, the fixing device control unit 107 heats the heat roller 19 in the image forming unit 11. A thermistor detects a temperature of the heat roller 19, and the fixing device control unit 107 controls the heating member, so that the heat roller 19 has a specific temperature. Then, the fixing device control unit 107 controls the heat roller 19 to rotate according to the transportation of the sheet S with the toner image transferred thereon.

In the embodiment, the drive control unit 108 applies a specific plus to the sheet discharge motor 10, and controls rotations of the first sheet discharge roller 32 and the second sheet discharge roller 35. Further, the drive control unit 108 controls on/off of the solenoid 46.

An operation of the sheet discharge unit 16 when an image is formed on one side of the sheet S and the face down sheet discharge is performed with respect to the sheet placing unit 21 will be explained next. In the embodiment, the first switch guide 33 and the second switch guide 36 have distal end portions 33*e* and 36*e*, respectively. Further, the first switch guide 33 and the second switch guide 36 have base portions 33*f* and 36*f*, respectively.

First, the first sheet supply roller 27 of the sheet supply unit 12 picks up the sheet S one by one from the sheet cassette 12*a*, and transports the sheet S toward a downstream side in the transportation direction. Then, the first transportation roller 29 and the second transportation roller 30 transport the sheet S to the transfer portion between the photosensitive drum 22 and the transfer roller 14, so that the toner image formed on the photosensitive drum 22 is transferred to a front side (one side) of the sheet S. Afterward, the heat roller 19 controlled at a specific temperature and the pressure roller 20 apply heat and pressure to the sheet S, thereby fixing the toner image to the sheet S.

When the print control unit 101 receives a direction from the host computer 110 for performing the face down sheet discharge, a sheet discharge processing unit 101*a* of the print control unit 101 performs the face down sheet discharge. When the sheet discharge sensor 31 detects the sheet S, the print control unit 101 sends a direction to the drive control unit 108, thereby turning off the solenoid 46 (refer to FIG. 3).

Accordingly, as shown in FIG. 6, the first switch guide 33 and the second switch guide 36 are situated at the first switching position, so that the distal end portions 33*e* and 36*e* of the first switch guide 33 and the second switch guide 36 face with each other at positions adjacent to each other. As a result, the first switch guide 33 and the second switch guide 36 form a transportation path connecting a transportation path for the face down sheet discharge and the reverse path 91, and a transportation path for the face up sheet discharge is closed.

In the next step, the first sheet discharge roller 32 transports the sheet S, and the first switch guide 33 and the second switch guide 36 guide the sheet S. Accordingly, the second sheet discharge roller 35 discharges the sheet S outside the printer, and the sheet S is placed on the sheet placing unit 21 while the surface thereof with the image formed thereon faces downwardly. Through the process described above, the image is formed on the sheet S.

An operation of the sheet discharge unit 16 when images are formed on both sides of the sheet S and the face down sheet discharge is performed with respect to the sheet placing unit 21 will be explained next.

After the image is formed on the front side of the sheet S and the sheet S passes through the fixing unit 15, the first sheet discharge roller 32 and the second sheet discharge roller 35 transport the sheet S. After a rear edge of the sheet S passes through the first sheet discharge roller 32, the second sheet discharge roller 35 rotates in the reverse direction, so that the sheet S is transported toward the second switch guide 36.

In the next step, after the sheet S passes through the reverse guide 37 while the second switch guide 36 guides the sheet S, the sheet S is guided to the duplex transportation unit 17, so that the duplex transportation guide 41 guides the sheet S to the first duplex transportation roller 39 and the second duplex transportation roller 40. While the first duplex transportation roller 39 and the second duplex transportation roller 40 rotate, the sheet S is transported to the transfer portion one more time, so that the toner image is transferred to a backside (the other side) of the sheet S. Afterward, the sheet S passes through the fixing unit 15, so that the toner image is fixed to the sheet S. Then, the first sheet discharge roller 32 and the second sheet discharge roller 35 discharge the sheet S to the sheet placing unit 21.

An operation of the sheet discharge unit 16 when an image is formed on one side of the sheet S and the face up sheet discharge is performed with respect to the sheet placing tray 51 will be explained next. When the face up sheet discharge is performed, the sheet placing tray 51 is manually opened with respect to the apparatus main body 18 as shown in FIG. 7.

First, the second sheet supply roller 28 of the manual feeder unit 13 picks up the sheet S one by one, and transports the sheet S toward the downstream side in the transportation direction. Then, the second transportation roller 30 transports the sheet S to the transfer portion, so that the toner image formed on the photosensitive drum 22 is transferred to the sheet S. Afterward, the heat roller 19 controlled at a specific temperature and the pressure roller 20 apply heat and pressure to the sheet S, thereby fixing the toner image to the sheet S.

When the print control unit 101 receives a direction from the host computer 110 for performing the face up sheet discharge, the sheet discharge processing unit 101*a* of the print control unit 101 performs the face up sheet discharge. When the sheet discharge sensor 31 detects the sheet S, the print control unit 101 sends a direction to the drive control unit 108, thereby turning on the solenoid 46.

Accordingly, as shown in FIG. 8, the first switch guide 33 and the second switch guide 36 are situated at the second switching position, so that the distal end portion 33*e* of the first switch guide 33 moves closer to the roller 32*m* and the distal end portion 36*e* of the second switch guide 36 moves closer to the pressure roller 32*n*. As a result, the first switch guide 33 and the second switch guide 36 form a transportation path for the face up sheet discharge. Further, the first switch guide 33 closes the transportation path for the face down sheet discharge, and the second switch guide 36 closes the reverse path 91.

In the next step, while the first switch guide 33 guides the sheet S, the first sheet discharge roller 32 transports the sheet S, so that the front edge of the sheet S contacts with the sheet placing tray 51. After the sheet S passes through the first sheet discharge roller 32, the second switch guide 36 guides the sheet S, so that the rear edge of the sheet S is discharged outside the printer and is placed on the sheet placing tray 51. After the sheet S is discharged, the solenoid 46 is turned off according to a direction of the drive control unit 108.

An operation of the sheet discharge unit 16 when images are formed on both sides of the sheet S and the face up sheet discharge is performed with respect to the sheet placing tray 51 will be explained next.

After the image is formed on the front side of the sheet S and the sheet S passes through the fixing unit 15, the first sheet discharge roller 32 and the second sheet discharge roller 35 transport the sheet S. After a rear edge of the sheet S passes through the first sheet discharge roller 32, the second sheet discharge roller 35 rotates in the reverse direction, so that the sheet S is transported toward the second switch guide 36.

In the next step, after the sheet S passes through the reverse guide 37 while the second switch guide 36 guides the sheet S, the sheet S is guided to the duplex transportation unit 17, so that the duplex transportation guide 41 guides the sheet S to the first duplex transportation roller 39 and the second duplex transportation roller 40. While the first duplex transportation roller 39 and the second duplex transportation roller 40 rotate, the sheet S is transported to the transfer portion one more time, so that the toner image is transferred to a backside (the other side) of the sheet S. Afterward, the sheet S passes through the fixing unit 15, so that the toner image is fixed to the sheet S.

When the print control unit 101 receives the direction from the host computer 110 for performing the face up sheet discharge, the sheet discharge processing unit 101*a* of the print control unit 101 performs the face up sheet discharge. When the sheet discharge sensor 31 detects the sheet S, the print control unit 101 sends a direction to the drive control unit 108, thereby turning on the solenoid 46.

Accordingly, as shown in FIG. 8, the first switch guide 33 and the second switch guide 36 are situated at the second switching position.

In the next step, while the first switch guide 33 guides the sheet S, the first sheet discharge roller 32 transports the sheet S, so that the front edge of the sheet S contacts with the sheet placing tray 51. After the sheet S passes through the first sheet discharge roller 32, the second switch guide 36 guides the sheet S, so that the rear edge of the sheet S is placed on the sheet placing tray 51. After the sheet S is discharged, the solenoid 46 is turned off according to a direction of the drive control unit 108.

As described above, in the embodiment, the first switch guide 33 and the second switch guide 36 are disposed on the downstream side of the first sheet discharge roller 32. When the first switch guide 33 and the second switch guide 36 are situated at the first switching position, the transportation path for the face up sheet discharge is closed. Further, the transportation path for the face down sheet discharge is opened, and the reverse path 91 is opened.

When the first switch guide 33 and the second switch guide 36 are situated at the second switching position, the transportation path for the face up sheet discharge is opened. Further, the transportation path for the face down sheet discharge is closed, and the reverse path 91 is closed. Accordingly, it is possible to perform the duplex printing in the state that the sheet placing tray 51 is opened with respect to the apparatus main body 18.

The flow chart shown in FIG. 5 will be explained next. In step S1, it is determined whether the solenoid 46 is turned on. When the solenoid 46 is turned on, the process proceeds to step S2. When the solenoid 46 is turned off, the process proceeds to step S3.

In step S2, the solenoid 46 is turned off. In step S3, it is determined whether the duplex printing is performed. When it is determined that the duplex printing is performed, the process proceeds to step S4. When it is determined that the duplex printing is not performed, the process proceeds to step S5.

In step S4, the second sheet discharge roller 35 rotates in the reverse direction. In step S5, it is determined whether the face up sheet discharge is performed. When it is determined that the face up sheet discharge is performed, the process proceeds to step S6. When it is determined that the face up sheet discharge is not performed, the process is completed.

In step S6, the solenoid 46 is turned on. In step S7, the switch lever 45 rotates to rotate the first switch guide 33 and the second switch guide 36. In step S6, when the sheet S is discharged, the solenoid 46 is turned off, thereby completing the process.

Second Embodiment

A second embodiment of the present invention will be described below. In the description below, elements in the second embodiment similar to those in the first embodiment are designated by same reference numerals, and explanations thereof are omitted. Explanations of operations and effects in the second embodiment similar to those in the first embodiment are omitted.

Figure 9:
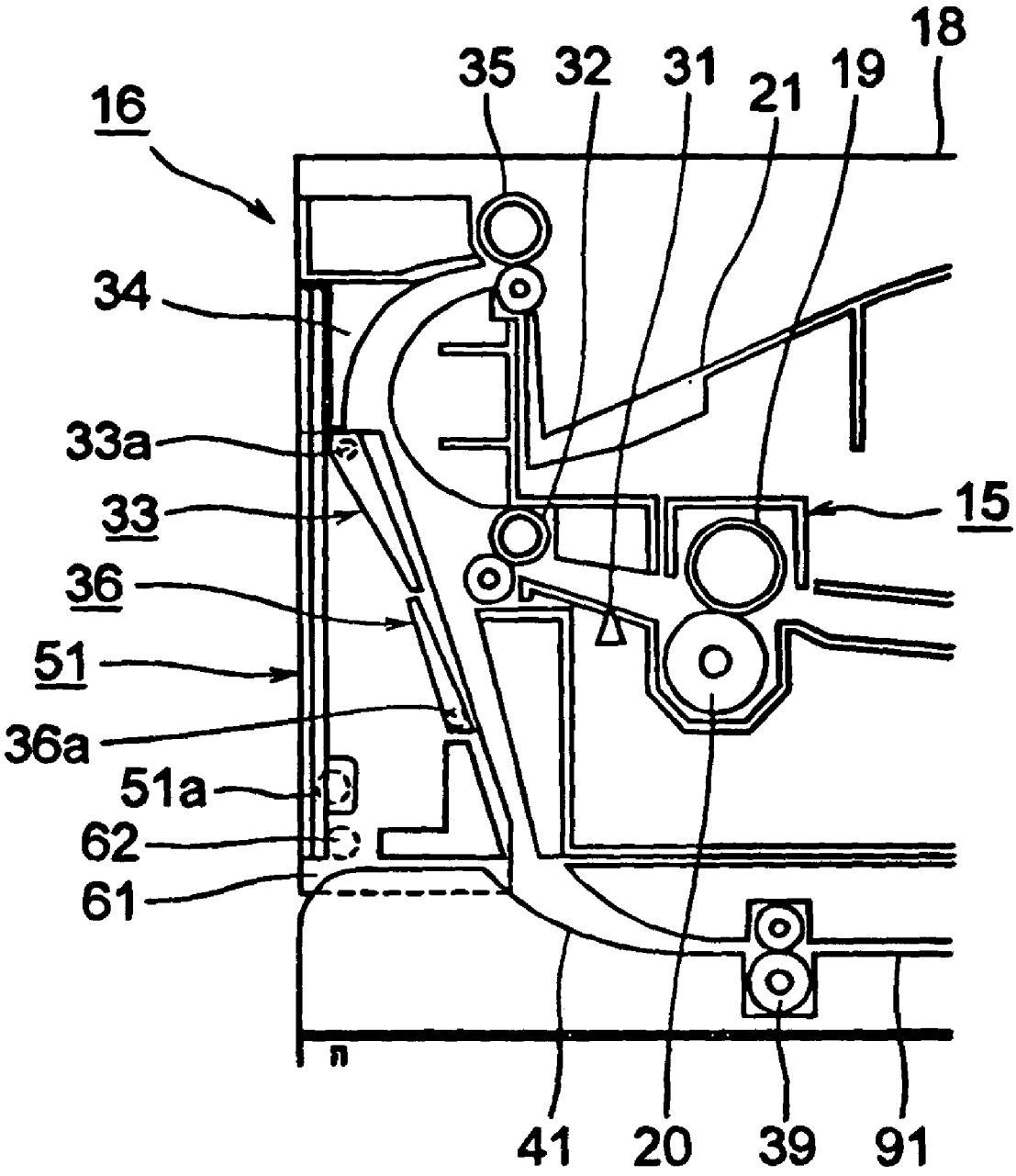
FIG. 9 is a schematic sectional view showing a sheet discharge unit when the sheet discharge unit performs face down sheet discharge according to a second embodiment of the present invention.
Figure 10:
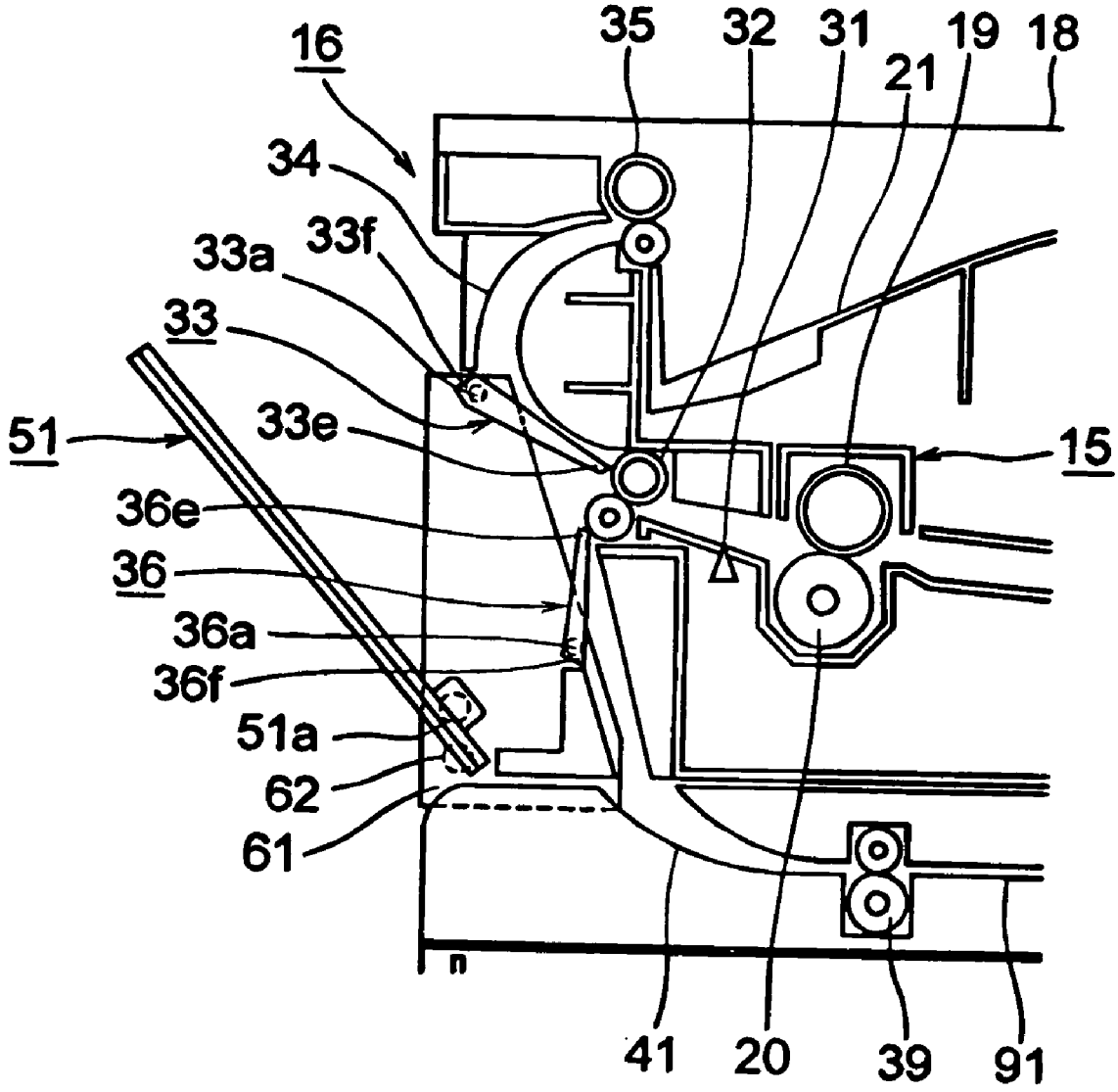
FIG. 10 is a schematic sectional view showing the sheet discharge unit when the sheet discharge unit performs face up sheet discharge according to the second embodiment of the present invention.
Figure 11:
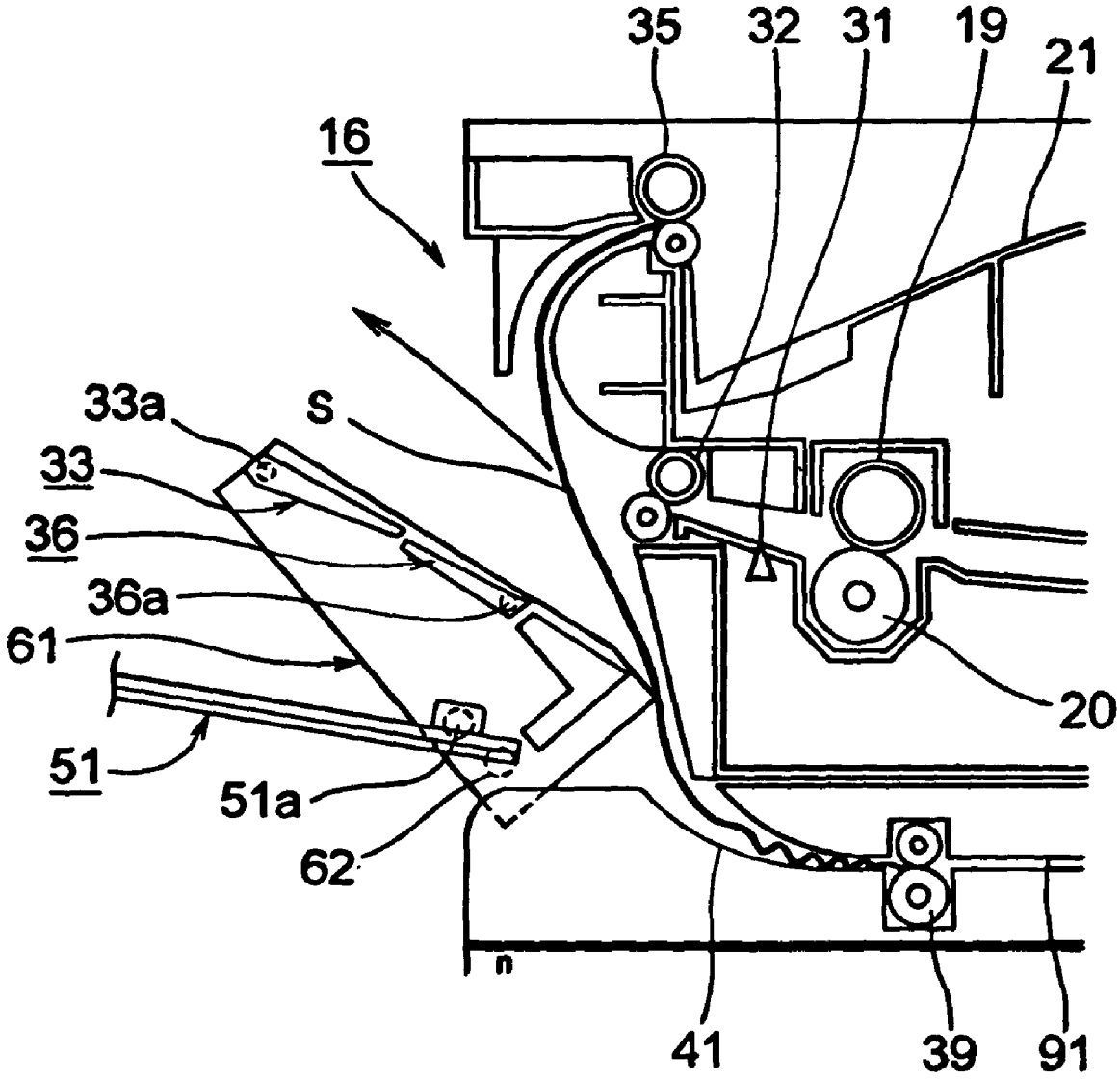
FIG. 11 is a schematic sectional view showing a jam release guide in an open state according to the second embodiment of the present invention.

FIG. 9 is a schematic sectional view showing the sheet discharge unit 16 when the sheet discharge unit 16 performs the face down sheet discharge according to the second embodiment of the present invention. FIG. 10 is a schematic sectional view showing the sheet discharge unit 16 when the sheet discharge unit 16 performs the face up sheet discharge according to the second embodiment of the present invention. FIG. 11 is a schematic sectional view showing a jam release guide 61 in an open state according to the second embodiment of the present invention.

In the embodiment, the jam release guide 61 is disposed to be freely rotatable with respect to the apparatus main body 18 around a shaft 62 provided at a lower portion of the apparatus main body 18. The sheet placing tray 51 as the medium placing tray is disposed to be freely rotatable around the shaft 51*a*. Further, the jam release guide 61 is provided with the first switch guide 33 and the second switch guide 36 constituting the first guide portion and the second guide portion; the switch lever 45 as the movement member (refer to FIG. 3); and the solenoid 46 as the switch drive portion.

An operation of the sheet discharge unit 16 will be explained next. Similar to the first embodiment, when the face down sheet discharge is performed with respect to the sheet placing unit 21, the first switch guide 33 and the second switch guide 36 are situated at the first switching position as shown in FIG. 9. When the face up sheet discharge is performed with respect to the sheet placing tray 51, the sheet placing tray 51 becomes the open state with respect to the apparatus main body 18, and the first switch guide 33 and the second switch guide 36 are situated at the second switching position as shown in FIG. 10.

When the sheet S is jammed in the reverse path 91, and the image forming operation is interrupted, an operator rotates and opens the jam release guide 61 as shown in FIG. 11, so that a part of the reverse path 91 is opened. Accordingly, the operator can remove the sheet S (jam process). In this case, a part of the reverse path 91 is opened, thereby making it easy to remove the sheet S in the reverse path 91.

As described above, in the embodiments, the printer is provided with the image forming unit 11, and the toner image as the developer image is directly transferred to the sheet S. Alternatively, the printer may be provided with a plurality of image forming units and transfer belts, so that toner images in various colors are transferred to the sheet S, thereby forming a color image.

Further, in the embodiments, the printer is explained as the image forming apparatus, and the present invention is applicable to a copier, a facsimile, a multifunction product, and the likes.

The disclosure of Japanese Patent Application No. 2007-166302, filed on Jun. 25, 2007, is incorporated in the application.

While the invention has been explained with reference to the specific embodiments of the invention, the explanation is illustrative and the invention is limited only by the appended claims.

What is claimed is:

1. An image forming apparatus comprising:

a first guide portion disposed to be movable for opening a transportation path of a medium;

a second guide portion disposed to be movable for opening the transportation path and arranged adjacent to the first guide portion, said second guide portion being arranged to guide a rear edge of the medium when the first guide portion and the second guide portion close the transportation path;

a switch drive portion for driving the first guide portion and the second guide portion;

a first transportation member for transporting the medium to the transportation path; and a second transportation member for discharging the medium from the transportation path to outside the image forming apparatus.

2. The image forming apparatus according to claim 1, wherein said first guide portion and said second guide portion are arranged to transport the medium along the transportation path so that the second transportation member discharges the medium outside the image forming apparatus when an image is formed on one side of the medium and a direction is received for discharging the medium with the one side facing downwardly.

3. The image forming apparatus according to claim 1, wherein said first guide portion and said second guide portion are arranged to close the transportation path so that the second transportation member discharges the medium outside the image forming apparatus when an image is formed on one side of the medium and a direction is received for discharging the medium with the one side facing upwardly.

4. The image forming apparatus according to claim 1, wherein said first guide portion and said second guide portion are arranged to open the transportation path so that the second transportation member discharges the medium outside the image forming apparatus after a first image is formed on a front side of the medium, the second transportation member reverses the medium, and a second image is formed on a backside of the medium when duplex printing is directed and a direction is received for discharging the medium with the backside facing downwardly.

5. The image forming apparatus according to claim 1, wherein said first guide portion and said second guide portion are arranged to open the transportation path so that a first image is formed on a front side of the medium and the second transportation member reverses the medium, said first guide portion and said second guide portion being arranged to close the transportation path so that the second transportation member discharges the medium outside the image forming apparatus after a second image is formed on a backside of the medium when duplex printing is directed and a direction is received for discharging the medium with the backside facing upwardly.

6. The image forming apparatus according to claim 1, further comprising a holding member disposed to be freely rotatable for holding the first guide member portion and the second guide portion, said holding member being arranged to open a part of the transportation path.

7. The image forming apparatus according to claim 1, further comprising a medium placing tray disposed outside the first guide portion and the second guide portion, said medium placing tray being arranged to open when the first guide portion and the second guide portion open the transportation path, said medium placing tray being arranged to place the medium thereon when the first guide portion and the second guide portion close the transportation path.

8. The image forming apparatus according to claim 1, further comprising a movement member for connecting the switch drive portion to the first guide portion and the second guide portion.

9. The image forming apparatus according to claim 8, further comprising an urging member for urging the movement member in a specific direction against a drive force of the switch drive portion.

* * * * *